United States Patent [19]

Schiff

[11] 4,224,139

[45] Sep. 23, 1980

[54] TREATMENT OF SULFUR-CONTAINING LUBRICATING OIL TO INCREASE RESISTANCE TO OXIDATION

[75] Inventor: Sidney Schiff, Bartlesville, Okla.

[73] Assignee: Phillips Petroleum Company, Bartlesville, Okla.

[21] Appl. No.: 30,505

[22] Filed: Apr. 16, 1979

[51] Int. Cl.[2] ..... C10G 19/02

[52] U.S. Cl. ..... 208/18; 208/203; 208/288

[58] Field of Search ..... 208/189, 203, 208 R, 208/226, 230, 241, 288, 18

[56] References Cited

U.S. PATENT DOCUMENTS

| | | | |
|---|---|---|---|
| 1,980,189 | 11/1934 | Davis | 208/230 |
| 2,503,486 | 4/1950 | Himel | 208/241 |
| 2,768,121 | 10/1956 | Denton et al. | 208/241 |
| 3,051,645 | 8/1962 | Wilson et al. | 208/230 |
| 3,080,435 | 3/1963 | Nager | 208/226 |
| 4,081,354 | 3/1978 | Christman | 208/230 |

*Primary Examiner*—George Crasanakis

[57] ABSTRACT

A method for treating sulfur-containing lubricating oil, by contacting the oil with iodine in the presence of an aqueous solution of alkali and thereafter separating the treated oil from the contacting solution. A lubricating oil having increased resistance to oxidation produced by this method.

8 Claims, No Drawings

TREATMENT OF SULFUR-CONTAINING LUBRICATING OIL TO INCREASE RESISTANCE TO OXIDATION

BACKGROUND OF THE INVENTION

This invention relates to lubricating oils. In one of its aspects this invention relates to lubricating oils containing sulfur, particularly mercaptan sulfur. In another of its aspects this invention relates to a method for increasing the resistance to oxidation of petroleum lubricating oil.

Lubricatng oil, particularly in high temperature service, is susceptible to destructive oxidation unless it has been treated with an oxidation inhibitor—generally a zinc compound. This treatment is costly and also increases the sulfated ash concentration of the oil. The sulfated ash concentration may be subject to legislative control in the future.

It is therefore an object of this invention to provide a method for increasing the resistance to oxidation of petroleum lubricating oil without significantly affecting its sulfated ash content. It is another object of this invention to provide a treated lubricating oil of increased resistance to oxidation that does not have a significantly increased sulfated ash content.

Other aspects, objects and the various advantages of this invention will become apparent upon reading this specification and the appended claims.

STATEMENT OF THE INVENTION

According to this invention a method is provided for treating sulfur-containing lubricating oil. In the method the lubricating oil is contacted with iodine in the presence of an aqueous solution of alkali and, after treatment the treated oil is separated from the contacting solution thereby providing a petroleum lubricating oil having increased resistance to oxidation but without a significantly increased sulfated ash content.

The process is applicable to petroleum lubricating oil, particularly to solvent refined, paraffinic lubricant stock having a viscosity index of 100 or above and a Saybolt Viscosity at 210° F. in the range of about 39 to about 100 Saybolt Universal Seconds (SUS) preferably about 45 to about 75 SUS. In essence it involves a mild oxidation of the oil with elemental iodine in the presence of an aqueous solution that is alkaline.

While it is believed that the treating process involves chemical alteration of naturally occurring mercaptans (thiols) in the oil the invention should not be limited to this theory. Improvement is most evident, however, when the oil to be treated contains at least 50 parts per million (0.005 weight percent) of mercaptan sulfur.

The quantity of iodine that is used to treat the lubricating oil is from about 0.25–5 gram atoms of iodine per mole of mercaptans; preferably about 0.5–2 gram atoms of iodine per mole of mercaptans is used; most preferably about one gram atom of iodine is used to treat one mole of mercaptans.

Iodine can be added to the oil being treated in the form of crystalline solid at ordinary conditions. Also acceptable is the use of solutions of iodine in organic solvents such as carbon disulfide, chloroform or carbon tetrachloride, benzene, or oxygen-containing solvents such as ethanol, acetone, or diethyl ether.

Treatment with iodine should be performed in the presence of an aqueous solution of alkali obtained from compounds of elements of Groups Ia and IIa (the alkali metals and alkali earths) of the Periodic Table of the Elements. Among suitable compounds are included the hydroxides and carbonates of these elements, such as lithium, sodium, and potassium hydroxides; sodium and potassium carbonate; calcium, strontium, and barium hydroxides; and mixtures of these. The quantity of alkaline compounds used should be substantially equivalent to the quantity of iodine used, i.e., there should be present enough alkaline compounds to combine chemically with the iodine as the normal iodide salt.

The iodine and the basic aqueous solution can be added simultaneously in treating the oil. It is preferred, however, to first add the aqueous solution, then the iodine. Considerable agitation is required during the treatment, such as shaking or stirring the two-phase mixture. Improved contact of the phases decreases the contact time. Temperature of the mixture can range between ambient and about 150° C. Preferably it will be between about 50°–95° C. Treatment continues until essentially no elemental iodine remains in the oil being treated. This can be determined by, e.g., the disappearance of the characteristic brown color of the iodine from its solution in oil, by negative tests on starch iodide indicator paper in reactant vapors, or by any test that can detect small amounts of iodine. When essentially no elemental iodine remains agitation is stopped, the aqueous phase is separated from the oil, and the oil is washed one or more times with water to remove water-soluble matter from the oil. The resulting oil, now having increased oxidation stability, can be blended with additives such as detergent-dispersants, viscosity-index improvers, pour-point depressants, other oxidation inhibitors, etc.

EXAMPLE

The following example illustrates this invention.

In a 500 milliliter glass flask 120 grams of a paraffinic distillate, solvent refined to remove aromatics and having a viscosity of 98.2 Saybolt Universal Seconds at 100° F., was stirred with 10 milliliters of 0.1 normal aqueous sodium hydroxide. 0.130 grams iodine was added, the mixture was warmed to 60° C. and stirred. In two hours all free iodine was gone as evidenced by the brown color of the oil and by a negative test with moistened starch iodide paper held in the mouth of the flask.

After cooling, the oil was diluted with some n-heptane. The aqueous phase was separated, the oil was washed by shaking with water, and, after again separating the aqueous phase the oil was dried by filtering it through a bed of anhydrous magnesium sulfate. Heptane was removed from the oil by distillation in a rotary evaporator at about 60° C. and 10 torr pressure. Samples of both the untreated and the treated oil were analyzed for both total sulfur and mercaptan sulfur, and were tested for oxidation stability by ASTM D 2272-67, "Oxidation Stability of Steam Turbine Oils by Rotating Bomb". The stability test defines conditions under which the oil, water, and a copper catalyst are heated at 150° C. under 90 psi of oxygen in a rotating bomb, and the time required for the oxygen pressure to decrease by 25 psi is recorded. Table I contains the results of the analyses and the oxidation stability test.

TABLE I

| Oil | Total S, Wt. % | Thiol S, Wt. % | Time for $\Delta P = 25$ psi, min. |
|---|---|---|---|
| Untreated | 0.1 | 0.029 | 17 |

TABLE I-continued

| Oil | Total S, Wt. % | Thiol S, Wt. % | Time for Δ P = 25 psi, min. |
|---|---|---|---|
| Treated | 0.099 | 0.01 | 45 |

These tests show that although the iodine treatment did not significantly affect the total sulfur content of the oil, the time of the oxidation stability test substantially increased from 17 to 45 minutes. The data also show that the concentration of mercaptan sulfur was decreased by about 65 percent.

I claim:

1. A method for treating sulfur-containing lubricating oil to increase its resistance to oxidation without significantly affecting its sulfated ash content comprising:

(a) contacting said oil with iodine and with an aqueous solution of at least one compound containing an element of Group Ia or IIa of the Periodic Table of Elements and (b) separating the treated oil from the contacting step (a).

2. A method of claim 1 wherein said oil contains at least 50 parts per million of sulfur as mercaptan.

3. A method of claim 1 wherein the contacting includes agitation of the liquid mixture.

4. A method of claim 3 wherein said aqueous solution is mixed with said oil and then the iodine is added to the agitated liquid mixture.

5. A method of claim 1 wherein on initial contact with said oil the iodine is in the state chosen from crystalline solid or in solution in a suitable solvent.

6. A method of claim 2 wherein the iodine is initially present in an amount of about 0.25 to about 5 gram atoms of iodine per mole of mercaptan in said oil.

7. A method of claim 6 wherein agitated contact is continued until essentially no elemental iodine remains in the oil phase of the treatment liquids.

8. Lubricating oil treated by the method of claim 1.

* * * * *